US012252365B2

(12) United States Patent
Takeuchi et al.

(10) Patent No.: US 12,252,365 B2
(45) Date of Patent: Mar. 18, 2025

(54) MEDIUM PLACEMENT DEVICE

(71) Applicant: SEIKO EPSON CORPORATION, Tokyo (JP)

(72) Inventors: Moe Takeuchi, Shiojiri (JP); Tsutomu Ozaki, Matsumoto (JP); Shun Ito, Matsumoto (JP); Keiichi Yato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 18/069,410

(22) Filed: Dec. 21, 2022

(65) Prior Publication Data

US 2023/0202788 A1 Jun. 29, 2023

(30) Foreign Application Priority Data

Dec. 23, 2021 (JP) ..... 2021-209016

(51) Int. Cl.
*B65H 29/52* (2006.01)
*B65H 31/20* (2006.01)
*B65H 31/22* (2006.01)

(52) U.S. Cl.
CPC ..... *B65H 29/52* (2013.01); *B65H 31/20* (2013.01); *B65H 31/22* (2013.01); *B65H 2405/11* (2013.01); *B65H 2405/1111* (2013.01); *B65H 2405/11152* (2013.01);
(Continued)

(58) Field of Classification Search
CPC ..... B65H 31/00; B65H 31/20; B65H 29/52; B65H 2405/1111; B65H 2405/1112; B65H 2405/11152; B65H 2405/111646; B65H 2405/1117; B65H 2405/1118; B65H 2405/1412; B65H 2405/142;
(Continued)

(56) References Cited

U.S. PATENT DOCUMENTS

2014/0241849 A1* 8/2014 Herrmann ..... B65H 31/3063 414/812
2016/0083214 A1* 3/2016 Murodate ..... B65H 1/04 271/207
2016/0090261 A1 3/2016 Nagashima et al.
(Continued)

FOREIGN PATENT DOCUMENTS

JP 01231755 A * 9/1989 ..... B65H 31/02
JP 2016-69156 A 5/2016

*Primary Examiner* — Prasad V Gokhale
(74) *Attorney, Agent, or Firm* — WORKMAN NYDEGGER

(57) ABSTRACT

A medium placement device is configured to stack a plurality of sheets of a medium discharged from a discharge unit of a processing device. The medium placement device includes a plurality of support units being provided in a width direction intersecting with a discharge direction of the medium discharged from the discharge unit, and being configured to support the medium at a support surface from below in a gravitational direction. A first support unit and a second support unit are provided in an alternating manner in the width direction, the second support unit being arranged at a position lower than the first support unit in the gravitational direction when viewed in the width direction. The first support unit is provided with a bridging member configured to couple a lower side of the discharge unit in the gravitational direction and the support surface of the first support unit.

7 Claims, 15 Drawing Sheets

(52) U.S. Cl.
CPC ..... *B65H 2405/1118* (2013.01); *B65H 2405/312* (2013.01); *B65H 2701/11312* (2013.01)

(58) Field of Classification Search
CPC ..... B65H 2405/15; B65H 2405/312; B65H 2701/11312
See application file for complete search history.

(56) References Cited

U.S. PATENT DOCUMENTS

| | | | | |
|---|---|---|---|---|
| 2021/0024320 | A1* | 1/2021 | Ito | B65H 31/02 |
| 2022/0169474 | A1* | 6/2022 | Namiki | B65H 31/20 |

* cited by examiner

MEDIUM PLACEMENT DEVICE

The present application is based on, and claims priority from JP Application Serial Number 2021-209016, filed Dec. 23, 2021, the disclosure of which is hereby incorporated by reference herein in its entirety.

BACKGROUND

1. Technical Field

The present disclosure relates to a medium placement device.

2. Related Art

Medium placement devices having various configurations have hitherto been used in various processing devices for performing processing on a medium, such as a printer and a scanner. For example, JP-A-2016-69156 discloses a stacker device that receives and stacks a medium discharged from a printer.

The stacker device in JP-A-2016-69156 is a medium placement device that stacks a medium discharged from a printer. In some cases, a medium cannot suitably be stacked on such a medium placement device that stacks a medium discharged from a processing device, depending on a type of a medium to be used. For example, when a medium wound in a roll shape is used, the medium tends to be restored to a roll shape in some cases. Thus, a leading edge of the medium discharged from a discharge unit curls and hangs down before arriving at a support unit on which the medium is stacked, and cannot arrive at the support unit due to buckling. Alternatively, the leading edge of the medium is caught in a discharge path from the discharge unit to the support unit, and thus the medium is jammed.

SUMMARY

In order to solve the above-mentioned problem, a medium placement device according to the present disclosure is configured to stack a plurality of sheets of a medium discharged from a discharge unit of a processing device. The medium placement device includes a plurality of support units provided in a width direction intersecting with a discharge direction of the medium discharged from the discharge unit, and configured to support the medium at a support surface from below in a gravitational direction. As the plurality of support units, a first support unit and a second support unit are provided in an alternating manner in the width direction, the second support unit being arranged at a position lower than the first support unit in the gravitational direction when viewed in the width direction. The first support unit is provided with a bridging member configured to couple a lower side of the discharge unit in the gravitational direction and the support surface of the first support unit.

DESCRIPTION OF EXEMPLARY EMBODIMENTS

Figure 1:
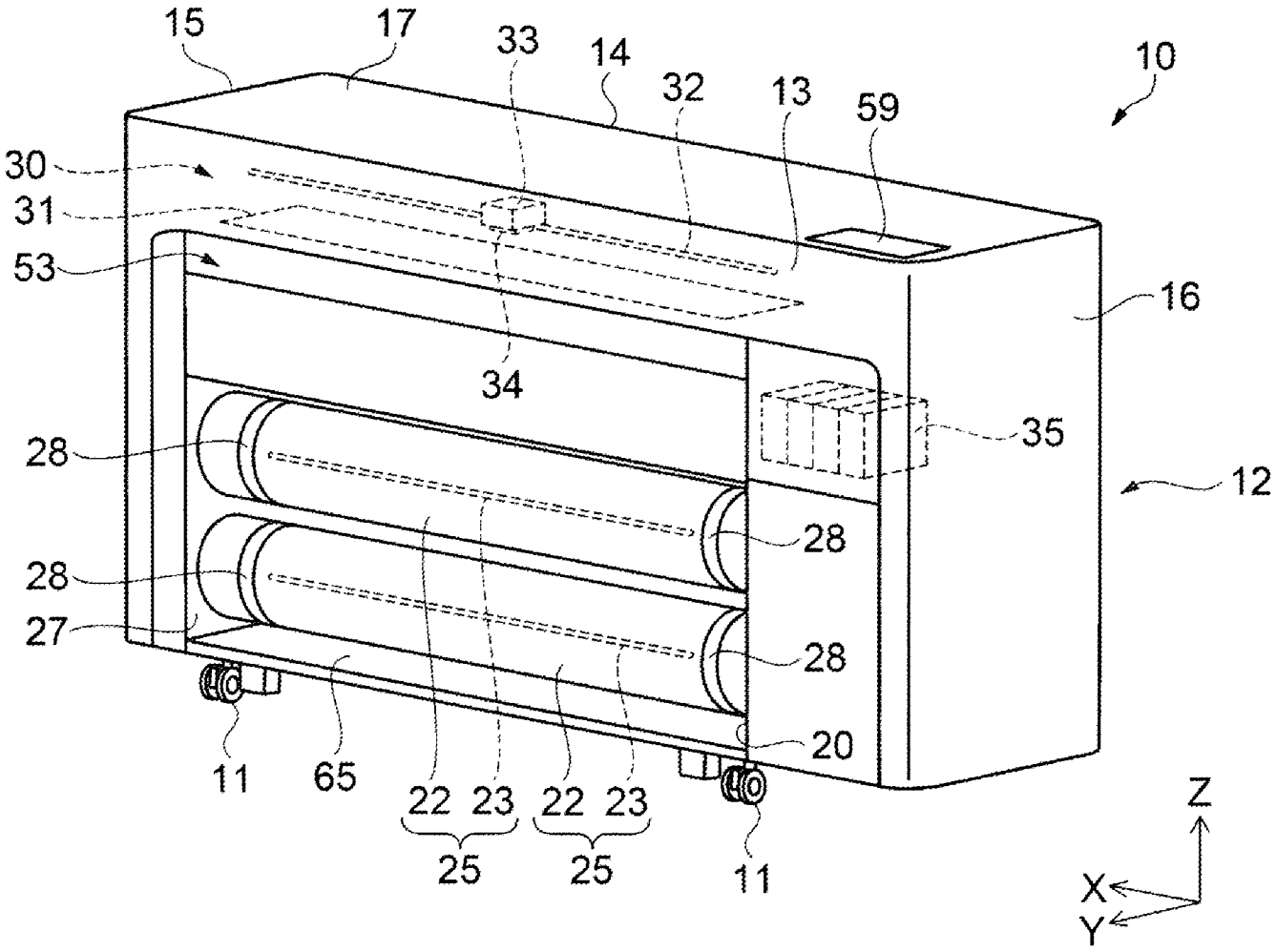
FIG. 1 is a perspective view of a recording device being an example of a processing device to which a medium placement device according to the present disclosure can be coupled.

First, the present disclosure is schematically described.

In order to solve the above-mentioned problem, a medium placement device according to a first aspect of the present disclosure is configured to stack a plurality of sheets of a medium discharged from a discharge unit of a processing device. The medium placement device includes a plurality of support units being provided in a width direction intersecting with a discharge direction of the medium, and being configured to support, on a support surface from below in a gravitational direction, the medium discharged from the discharge unit. As the plurality of support units, a first support unit and a second support unit are provided in an alternating manner in the width direction, the second support unit being arranged at a lower position in the gravitational direction with respect to the first support unit as viewed in the width direction. The first support unit is provided with a bridging member configured to couple a lower side of the discharge unit in the gravitational direction and the support surface of the first support unit.

According to the present aspect, the first support unit is provided with the bridging member that couples the lower side of the discharge unit in the gravitational direction and the support surface of the first support unit. With this, the leading edge of the medium to be discharged can be prevented from hanging down between the discharge unit and the support surface, and hence the medium to be discharged successfully arrives at the support surface. Further, the leading edge of the medium can be prevented from being caught in the discharge path from the discharge unit to the support unit. Therefore, the medium discharged from the processing device can suitable be stacked. Further, as the support units, the first support unit and the second support unit are provided in an alternating manner in the width direction. Thus, a moving medium can have a wavy shape as viewed in the discharge direction. With this, the leading edge in the discharge direction can be prevented from hanging down, and can also be prevented from being caught by the support surface or a placed medium.

In a medium placement device according to a second aspect of the present disclosure, in the first aspect, the plurality of support units and the bridging member extend in the discharge direction, and are inclined downward in the gravitational direction from upstream to downstream in the discharge direction.

According to the present aspect, the support unit and the bridging member extend in the discharge direction, and are inclined downward in the gravitational direction from upstream to downstream in the discharge direction. With this, the medium can be moved through use of a gravitational force, and the medium can efficiently be moved without using electric power or the like.

In a medium placement device according to a third aspect of the present disclosure, in the second aspect, the bridging member includes a first bridging portion extending from the first support unit in the discharge direction, a second bridging portion being provided to both sides of the first support unit in the width direction, and a third bridging portion being provided downstream of the second bridging portion in the discharge direction, and having a slope inclined downward in the gravitational direction from upstream to downstream in the discharge direction, the slope being steeper than the second bridging portion.

According to the present aspect, there are provided the second bridging portion and the third bridging portion being provided downstream of the second bridging portion in the discharge direction, and having a slope inclined downward in the gravitational direction from upstream to downstream in the discharge direction, the slope being steeper than the second bridging portion. With this, the medium to be discharged can firmly be held at the second bridging portion upstream in the discharge direction, and can have a wavy form at the third bridging portion downstream in the discharge direction. With this, the leading edge in the discharge direction can be prevented from hanging down, and can also be prevented from being caught by the support surface or a placed medium in a particularly effective manner.

In a medium placement device according to a fourth aspect of the present disclosure, in any one of the first aspect to the third aspect, the bridging member has a steep inclination portion, at an upstream end thereof in the discharge direction, having a slope inclined downward in the gravitational direction from upstream to downstream in the discharge direction, the slope being steeper than a region other than the upstream end in the discharge direction.

For example, depending on a type of a medium, a medium has a leading edge that tends to hang down particularly easily. However, according to the present aspect, the bridging member includes the steep inclination portion at the upstream end thereof in the discharge direction. With this, even when the leading edge of the medium hangs down, the leading edge is brought into contact with the steep inclination portion. With this, an entry angle of the leading edge into the bridging member can be reduced, and the medium can be moved in a particularly effective manner.

In a medium placement device according to a fifth aspect of the present disclosure, in any one of the first aspect to the fourth aspect, the bridging member includes a high friction portion at the upstream end thereof in the discharge direction, the high friction portion having a higher static friction coefficient, with respect to the medium, than that in a region other than the upstream end in the discharge direction.

According to the present aspect, the bridging member includes the high friction portion at the upstream end thereof in the discharge direction. With this, a placed medium that is placed on the medium placement device can prevented from sliding due to a gravitational force and moving from a desired placement position, and the placed medium can be prevented from being pushed by a subsequent medium, which is discharged from the discharge unit and moves, and moving from the desired placement position.

In a medium placement device according to a sixth aspect of the present disclosure, in any one of the first aspect to the fifth aspect, the bridging member is configured to be arranged below the discharge unit in the gravitational direction by a thickness corresponding to a plurality of sheets of the medium or by the thickness or more.

When the bridging member is formed flush with the discharge unit, there may be a risk that a placed medium is pushed by a subsequent medium, which is discharged from the discharge unit and moves, and moves from the desired placement position. However, according to the present aspect, the bridging member is configured to be arranged below the discharge unit with an interval equal to or larger than a thickness of the plurality of sheets of the medium. Thus, a plurality of sheets of the medium can suitably be stacked.

In a medium placement device according to a seventh aspect of the present disclosure, in any one of the first aspect to the sixth aspect, the bridging member includes a rotational movement shaft, and rotates about the rotational movement shaft with respect to the first support unit when a predetermined load or more is applied.

According to the present aspect, the bridging member includes the rotational movement shaft, and rotates about the rotational movement shaft with respect to the first support unit when a predetermined load or more is applied. With this, when a predetermined load or more is applied to the bridging member, breakage of the bridging member or the support unit can be prevented.

In a medium placement device according to an eighth aspect of the present disclosure, in any one of the first aspect to the seventh aspect, the bridging member is configured to be detachable from the first support unit, and is detached when a predetermined load or more is applied.

According to the present aspect, the bridging member is configured to be detachable from the first support unit, and is detached when a predetermined load or more is applied. With this, when a predetermined load or more is applied to the bridging member, breakage of the bridging member or the support unit can be prevented.

With reference to the drawings, exemplary embodiments relating to a medium placement device 100 according to the present disclosure are specifically described below. The medium placement device 100 according to the present disclosure is a medium placement device configured to stack a plurality of sheets of a medium 22 discharged from a discharge unit 53 of a recording device 10 being an example of a processing device. Note that the medium placement device 100 according to the present exemplary embodiment can be coupled to the recording device 10 being an example of a processing device, and may be coupled to a processing device other than the recording device, such as an image reading device. First, with reference to FIG. 1, an outline of the recording device 10 is described.

Note that, as for the coordinates illustrated in the drawings, assuming that a recording device 10 is placed on a horizontal installation surface, the three virtual axes orthogonal to one another are defined as an X-axis, a Y-axis, and a Z-axis. The X-axis is a virtual axis parallel to a right-left direction of the recording device 10. The Y-axis is a virtual axis parallel to a front-rear direction of the recording device 10. The Z-axis is a virtual axis parallel to a height direction (gravitational direction) of the recording device 10. A tip side of each of the arrows representing the X-axis, the Y-axis, and the Z-axis is a "+ side", and a base side thereof is the "− side". The recording device 10 illustrated in the present exemplary embodiment is a large-format printer that feeds an elongated medium 22 wound in a roll shape and performs recording by an ink-jet method. The recording device 10 in the present exemplary embodiment is a printer capable of performing recording on the medium 22 having a size of B0 plus to the maximum.

As illustrated in FIG. 1, the recording device 10 is installed through casters 11. The recording device 10 includes a housing 12 having a substantially rectangular parallelepiped shape that is elongated in X direction. The housing 12 has a front wall 13, a rear wall 14, a first side wall 15, a second side wall 16, and an upper wall 17. A direction in which a base frame 65 and the upper wall 17 face each other in the recording device 10 is a height direction of the recording device 10. A direction in which the first side wall 15 and the second side wall 16 face each other is a right-left direction of the recording device 10. A direction in which the front wall 13 and the rear wall 14 face each other is a front-rear direction of the recording device 10.

A recording unit 30 that performs recording on the medium 22 and includes a recording head 34, and an accommodation unit 20 that accommodates a roll body 25 in which the medium 22 is wound in a cylindrical shape are provided inside the housing 12. Further, although not illustrated in FIG. 1, a transport unit that transports the medium 22, a cutting unit that cuts the medium 22, and the like are provided.

A plurality of openings is formed in the front wall 13 of the housing 12. A roll body accommodation port 27 for accommodating the roll body 25 is formed on a side close to the base frame 65 below the front wall 13. Further, the discharge unit 53 for discharging the medium 22 after recording is formed on the upper side of the roll body accommodation port 27.

The roll body 25 having a cylindrical shape formed by winding the elongated medium 22 about a core member 23 is accommodated in the accommodation unit 20 through the roll body accommodation port 27. In the present exemplary embodiment, the accommodation unit 20 is configured so that two roll bodies 25 elongated in the X direction are arrayed in the Z direction. A pair of holding members 28 that holds the roll body 25 rotatably with respect to the accommodation unit 20 is attached to both ends of the roll body 25. When the roll body 25 is driven to rotate, the medium 22 wound about the roll body 25 is delivered to the side close to the rear wall 14 inside the housing 12. Further, the transport unit, which is not illustrated, transports the medium 22 to a support 31, and the medium 22 is transported from the side close to the rear wall 14 to the side close to the front wall 13 on the support 31.

The recording unit 30 includes the support 31, a guide member 32, a carriage 33, and the recording head 34. The support 31 is a plate-shaped member extending in the X direction in the housing 12, is positioned on the side close to the upper wall 17 with respect to the accommodation unit 20, and supports the medium 22 transported by the transport unit, which is not illustrated.

The recording head 34 is mounted on the carriage 33 that moves along the guide member 32. The recording head 34 is positioned on the side close to the support 31 with respect to the carriage 33. The recording head 34 is configured so as to reciprocate along the guide member 32 together with the carriage 33. The recording head 34 is coupled to a cartridge 35 that stores ink by a tube having flexibility, which is not illustrated. The recording head 34 performs recording on the medium 22 by ejecting the ink onto the medium 22 supported by the support 31 while moving in the X direction. The medium 22 after recording is cut by the cutting unit, which is not illustrated.

The recording device 10 further includes an input unit 59. The input unit 59 is provided at an upper surface of the upper wall 17 of the housing 12. The input unit 59 is configured, for example, by a liquid crystal display device provided with a touch panel, and is used when a user inputs various types of information.

First Exemplary Embodiment

Figure 2:
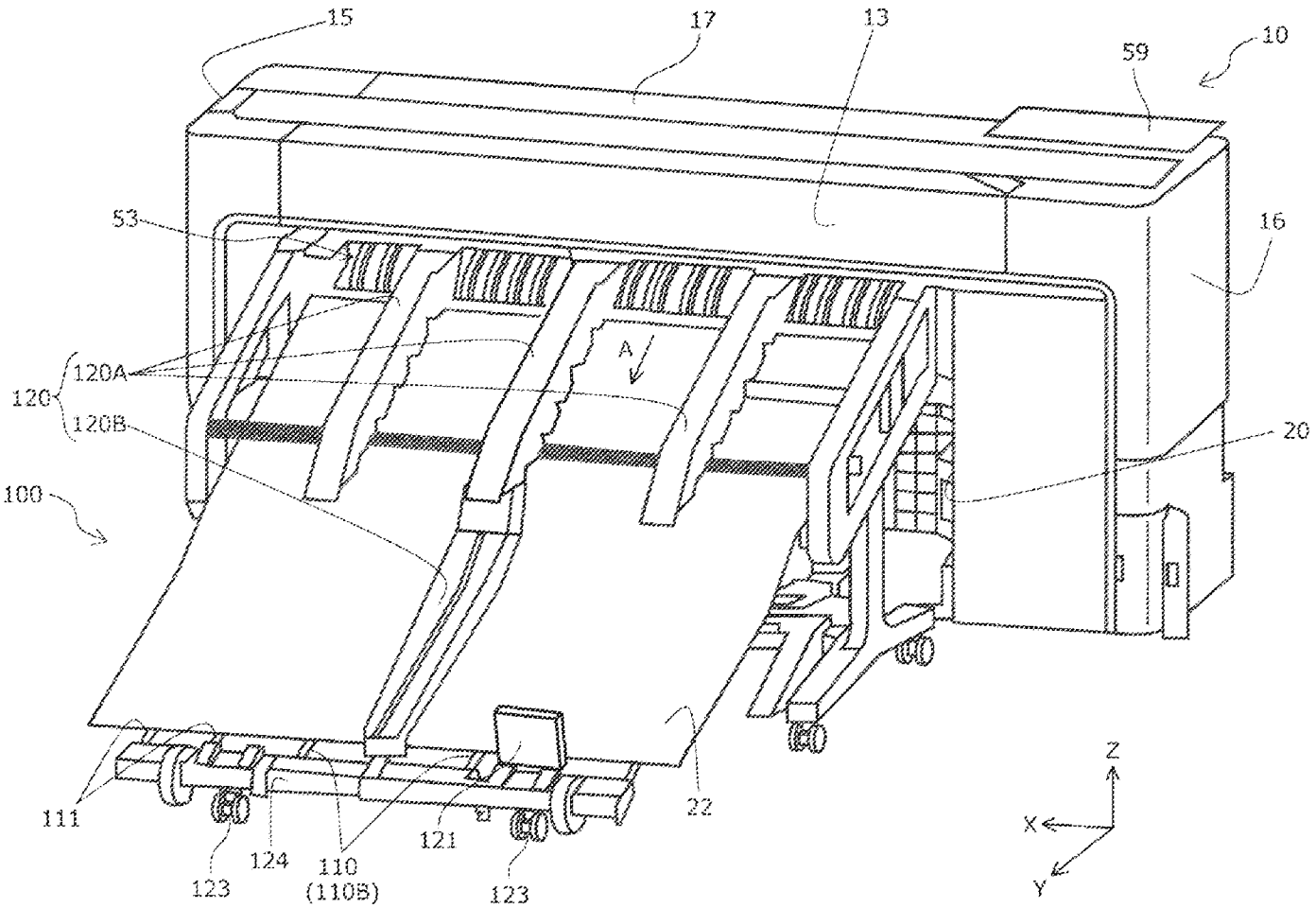
FIG. 2 is a perspective view illustrating a state in which a medium placement device according to a first exemplary embodiment of the present disclosure is coupled to the recording device in FIG. 1.
Figure 6:
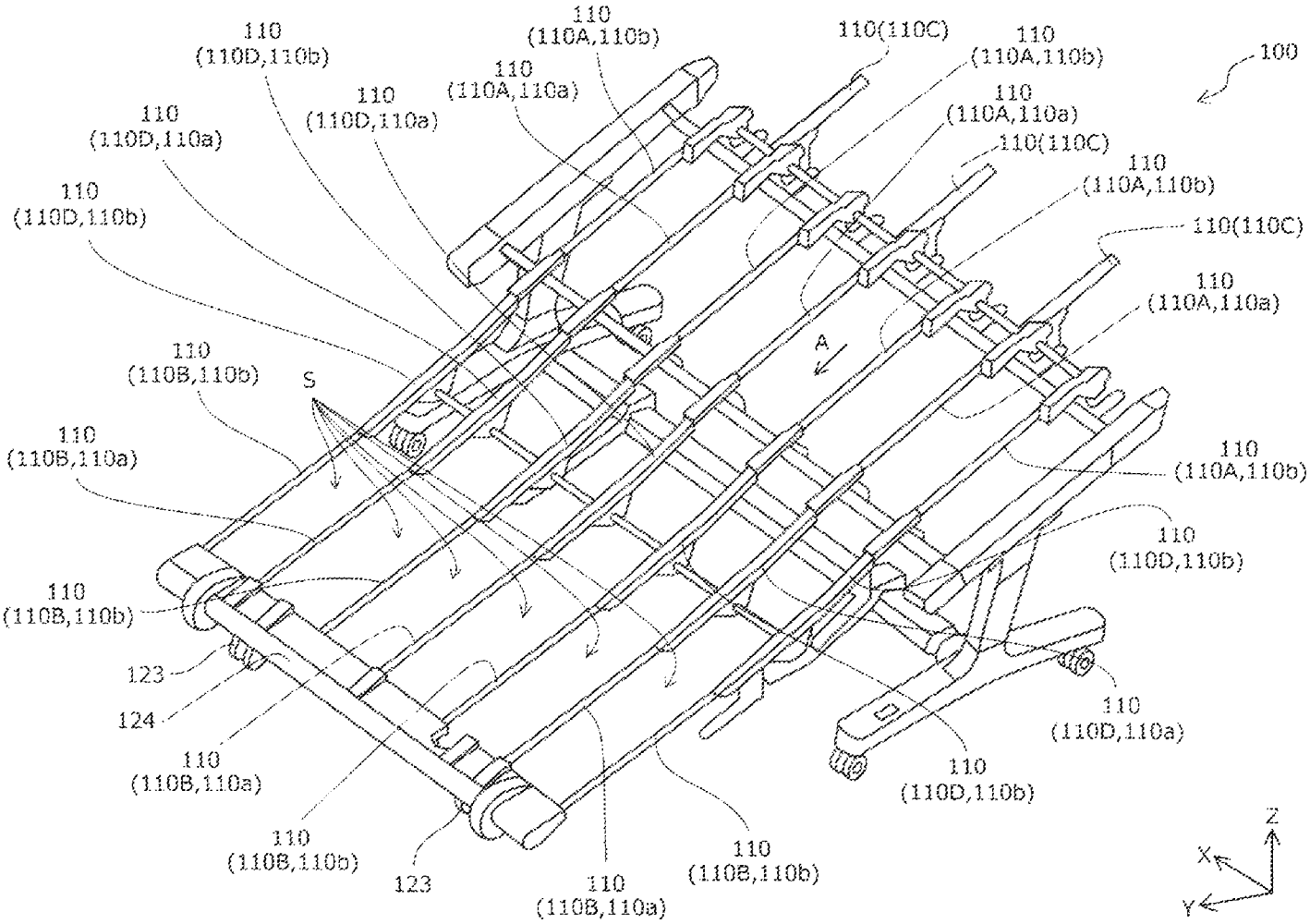
FIG. 6 is a perspective view illustrating a support unit of the medium placement device according to the first exemplary embodiment of the present disclosure.
Figure 7:
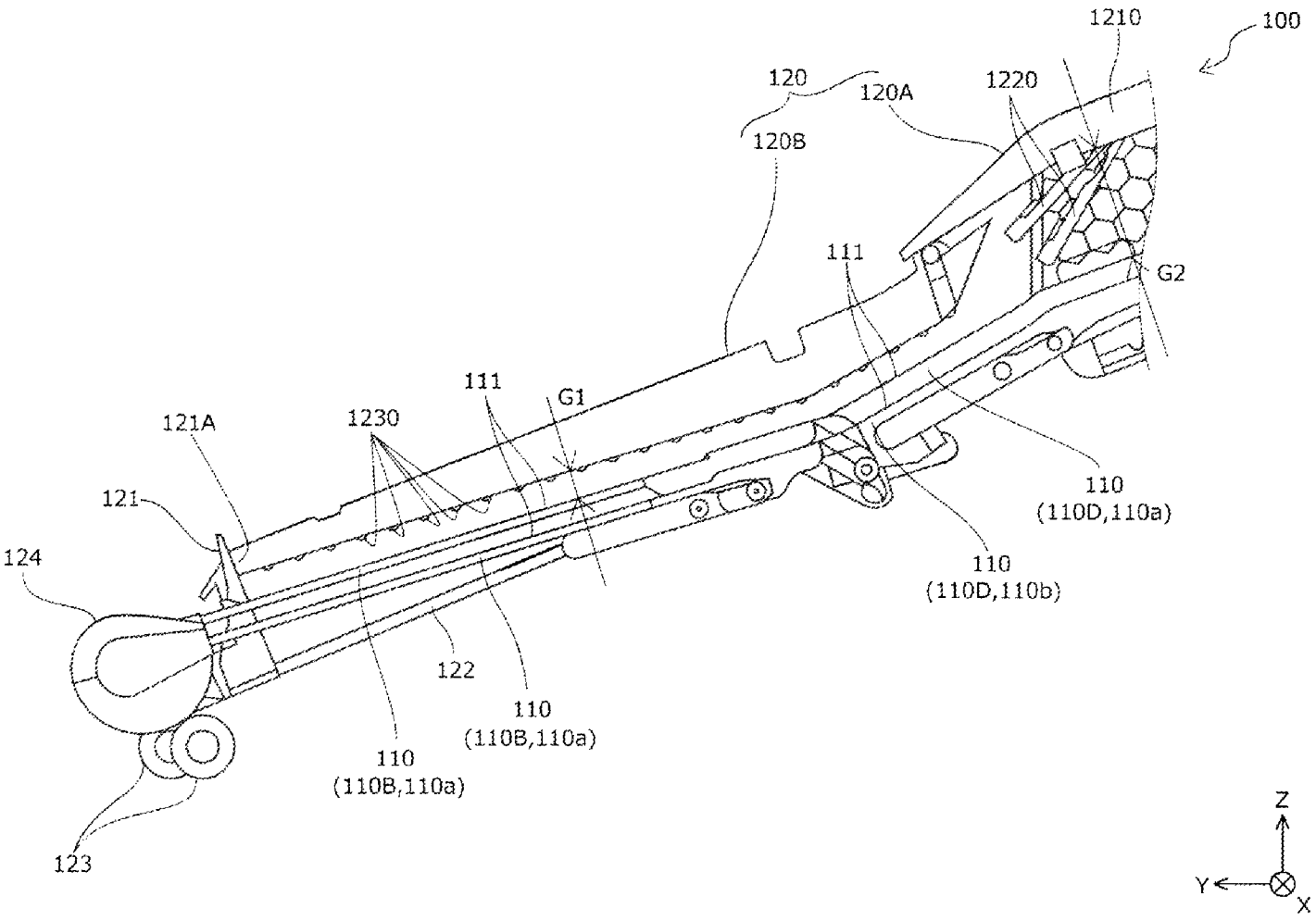
FIG. 7 is a side view illustrating part of the medium placement device according to the first exemplary embodiment of the present disclosure.
Figure 8:
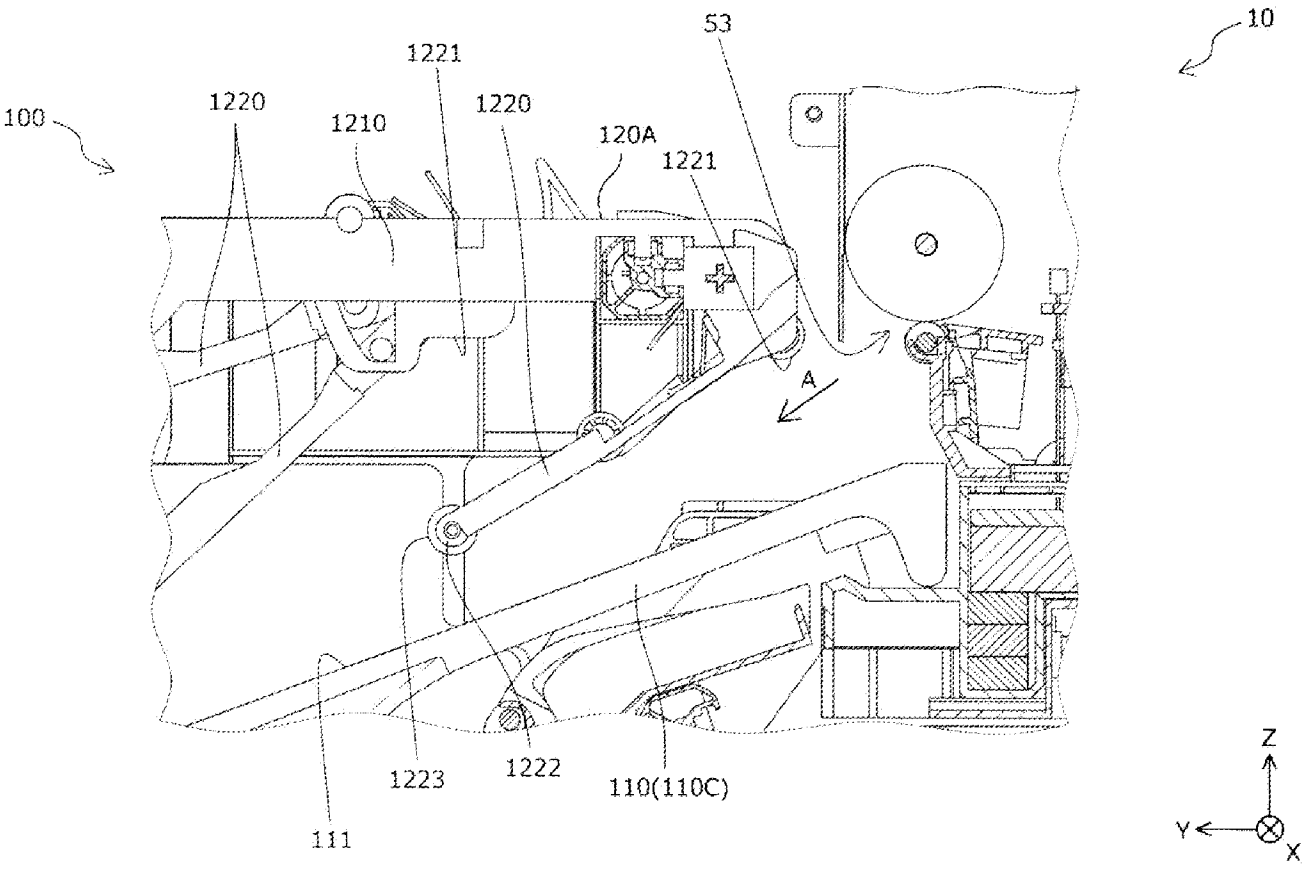
FIG. 8 is a side view illustrating a coupling portion that couples the medium placement device according to the first exemplary embodiment of the present disclosure to the recording device.

Next, with reference to FIG. 2 to FIG. 9, the medium placement device 100 according to the first exemplary embodiment of the present disclosure is specifically described. As illustrated in FIG. 2 and FIG. 8, the medium placement device 100 according to the present exemplary embodiment is configured to be coupled to the recording device 10 and to stack a plurality of sheets of the medium 22, which is discharged from the discharge unit 53 of the recording device 10 in a discharge direction A, on a support surface 111 of a support unit 110.

Figure 3:
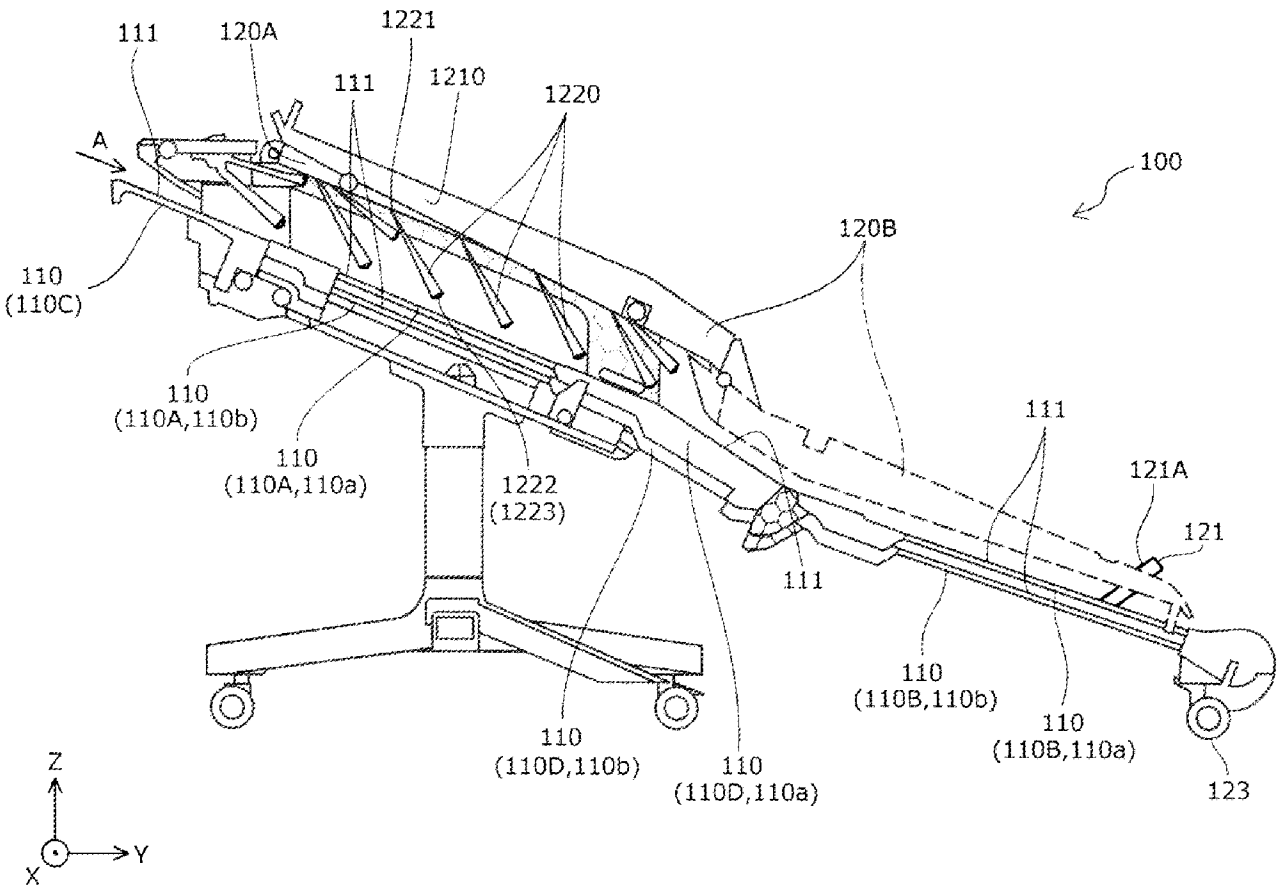
FIG. 3 is a side view of the medium placement device according to the first exemplary embodiment of the present disclosure.
Figure 4:
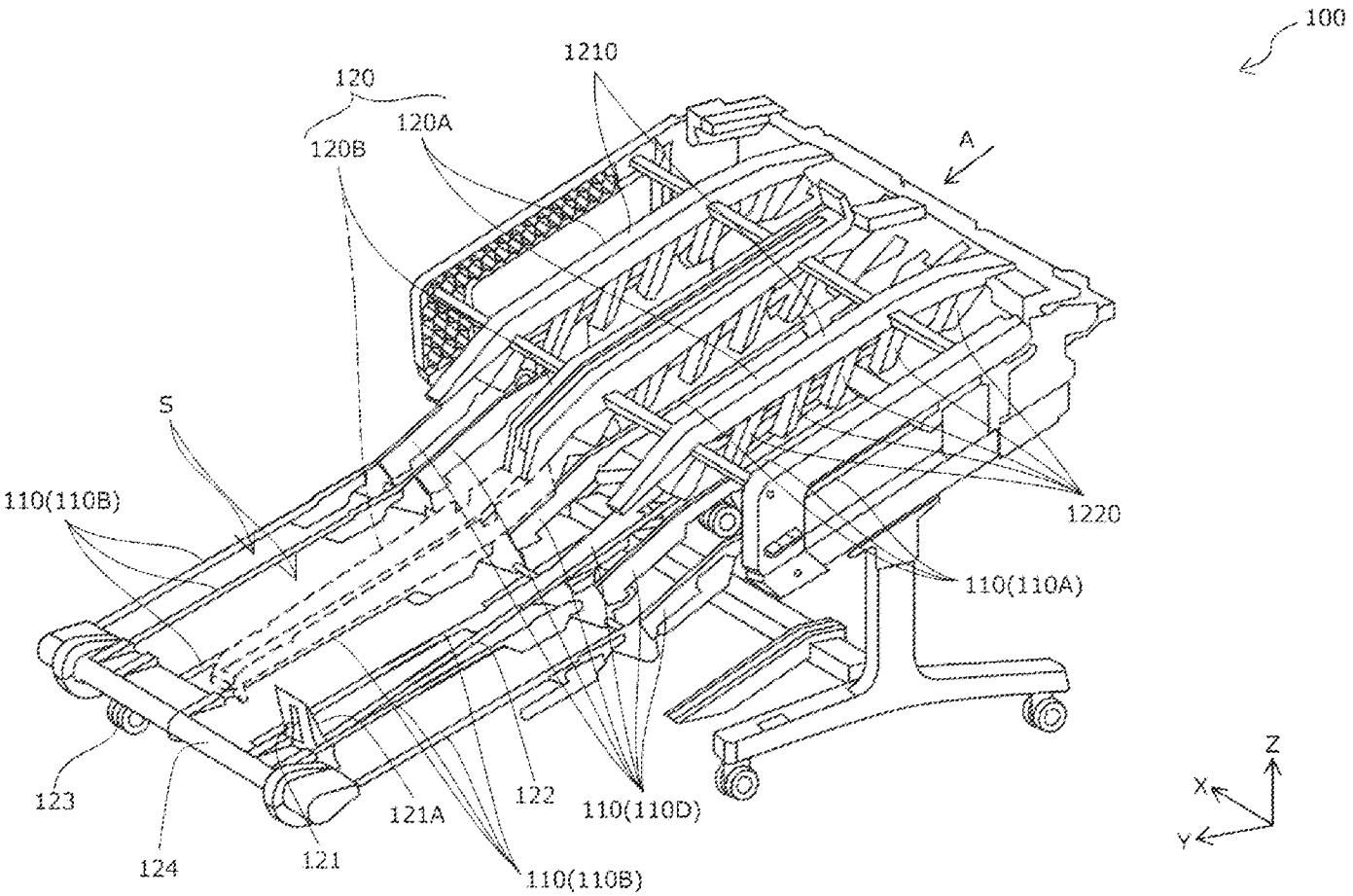
FIG. 4 is a perspective view of the medium placement device according to the first exemplary embodiment of the present disclosure.
Figure 5:
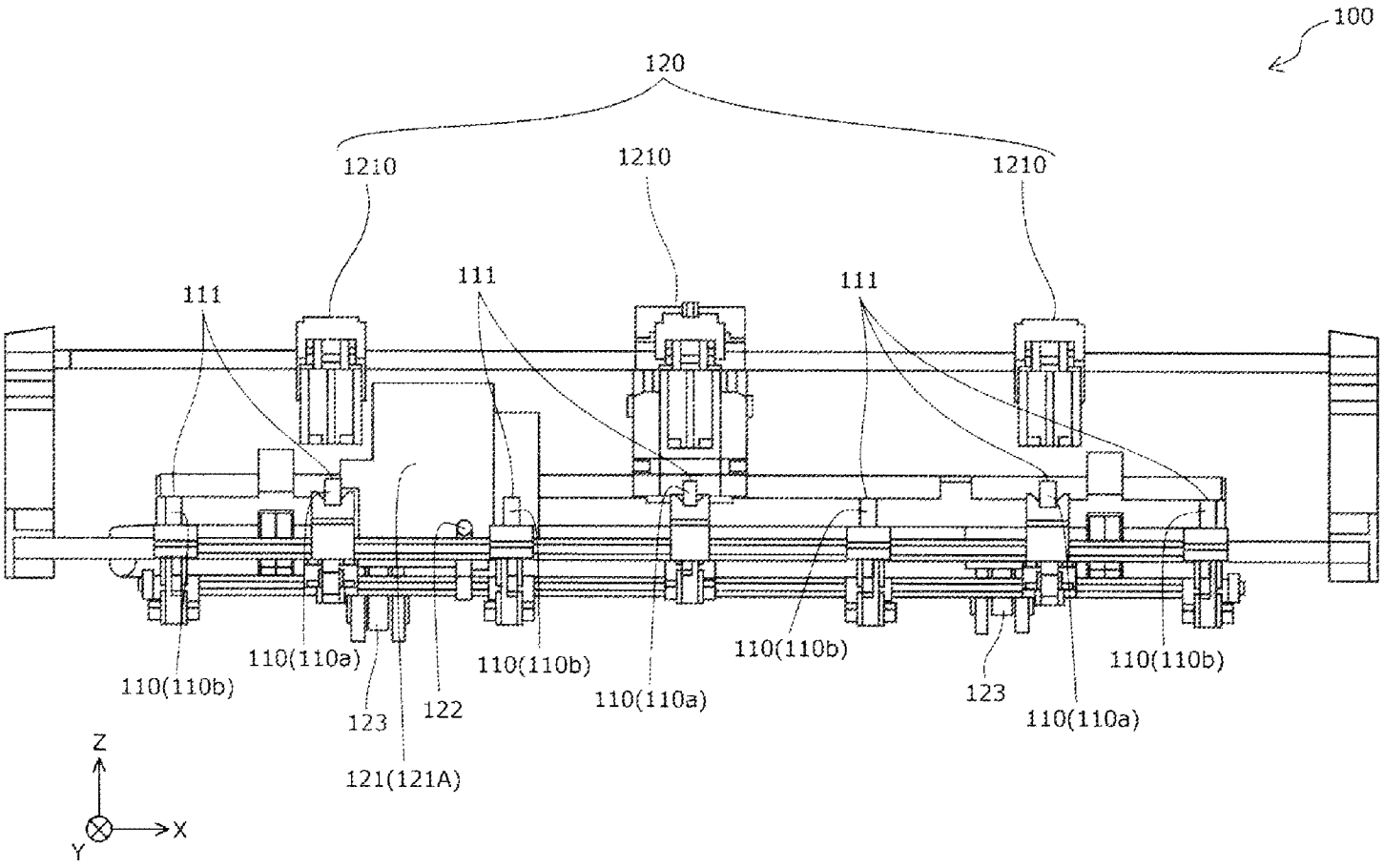
FIG. 5 is a back view of the medium placement device according to the first exemplary embodiment of the present disclosure.

As illustrated in FIG. 4 and FIG. 6, the medium placement device 100 according to the present exemplary embodiment includes a plurality of support units 110 provided in a width direction (X direction) intersecting with the discharge direction A of the medium 22. With this, the medium 22 discharged from the discharge unit 53 is supported on the support surface 111 from below in the gravitational direction (Z direction). In the medium placement device 100 according to the present exemplary embodiment, the plurality of support units are arranged so that the center positions of the adjacent support units 110 in the width direction are at an interval of 160 mm. Here, as illustrated in FIG. 3, FIG. 4, and the like, the support units 110 extend in the discharge direction A, and are inclined downward in the gravitational direction from upstream to downstream in the discharge direction A. Further, as the support units 110, a first support unit 110*a* and a second support unit 110*b* are provided in an alternating manner in the X direction, as illustrated in FIG. 5, FIG. 6, and the like. As illustrated in FIG. 3, the second support unit 110*b* is arranged at a lower position in the Z direction with respect to the first support unit 110*a* as viewed in the X direction.

In this manner, in the medium placement device 100 according to the present exemplary embodiment, the support unit 110 extends in the discharge direction A, and is inclined downward in the gravitational direction from upstream to downstream in the discharge direction A. With this, the medium 22 can be moved through use of a gravitational force, and the medium 22 can efficiently be moved without using electric power or the like. Further, as the support units 110, the first support unit 110*a* and the second support unit 110*b* are provided in an alternating manner in the width direction. Thus, the moving medium 22 can have a wavy form (cockling shape) as viewed in the discharge direction A. The leading edge in the discharge direction A can be prevented from hanging down, and can also be prevented from being caught by the support surface 111 or a placed medium that is previously placed on the support surface 111. Therefore, the medium placement device 100 according to the present exemplary embodiment is capable of stacking various types of the medium 22 in a stable manner without using electric power or the like. Note that, in the medium placement device 100 according to the present exemplary embodiment, as illustrated in FIG. 5, the heights of the first support units 110*a* and the heights of the second support units 110*b* are substantially the same. However, the above-described configuration is not intended to result in limitation. The heights of the first support units 110*a* and the heights of the second support units 110*b* may be different. Further, in the medium placement device 100 according to the present exemplary embodiment, a difference of the height of the first support unit 110*a* and the height of the second support unit 110*b* is 45 mm. However, the height is not limited to 45 mm as long as the medium 22 can have a wavy form.

Further, as illustrated in FIG. 3, FIG. 4, FIG. 6, and the like, in the medium placement device 100 according to the present exemplary embodiment, each of the support units 110 includes an upstream portion 110A that is positioned upstream in the discharge direction A, a downstream portion 110B that is positioned downstream of the upstream portion 110A in the discharge direction A, and an intermediate portion 110D that couples the upstream portion 110A and the downstream portion 110B to each other. In addition, a bridging member 110C is provided further upstream of the upstream portion 110A in the discharge direction A. The bridging member 110C couples the lower side of the discharge unit 53 of the recording device 10 and the upstream portion 110A to each other. Specifically, the bridging member 110C is provided to the first support unit 110*a*, and has a configuration of coupling the lower side of the discharge unit 53 in the gravitational direction and the support surface 111 of the first support unit 110*a*. The bridging member 110C may be regarded as a constituent part of the support unit 110, or may be regarded as a separate member that can be attached to the support unit 110.

As described above, in the medium placement device 100 according to the present exemplary embodiment, the first support unit 110*a* is provided with the bridging member 110C that couples the lower side of the discharge unit 53 in the gravitational direction and the support surface 111 of the first support unit 110*a*. With this, the medium placement device 100 according to the present exemplary embodiment can prevent the leading edge of the medium 22 to be discharged from hanging down between the discharge unit 53 and the support surface 111 of the first support unit 110*a*, and hence the medium 22 to be discharged successfully arrives at the support surface 111 of the first support unit 110*a*. Further, the leading edge of the medium 22 can also be prevented from being caught in the discharge path from the discharge unit 53 to the first support unit 110*a*. Therefore, the medium placement device 100 according to the present exemplary embodiment is capable of stacking the medium 22 discharged from the processing device in a stable manner.

Note that, in the medium placement device 100 according to the present exemplary embodiment, only the first support unit 110*a* is provided with the bridging member 110C, and the second support unit 110*b* is not provided with the bridging member 110C. However, the above-described configuration is not intended to result in limitation. As a configuration in which the first support unit 110*a* is provided with the bridging member 110C, there may be adopted a configuration in which the bridging member 110C is provided to the second support unit 110*b* in addition to the first support unit 110*a*. However, in such a case, it is preferred that the bridging member 110C provided to the second support unit 110*b* be arranged at a lower position in the gravitational direction as viewed in the X direction with respect to the bridging member 110C provided to the first support unit 110*a*. With this, the moving medium 22 can have a wavy form as viewed in the discharge direction A, and the leading edge of the medium 22 moving on the bridging member 110C can prevented from hanging down.

Further, in the present exemplary embodiment, the first support unit 110*a* and the bridging member 110C are configured so as to be continuously linear as viewed in the X direction, and the first support unit 110*a* and the bridging member 110C are inclined at the same degree. However, the above-described configuration is not intended to result in limitation. Inclination of the bridging member 110C can be determined as appropriate in accordance with a distance between the processing device such as the recording device 10 and the medium placement device 100, the position of the discharge unit 53, or the like.

Note that, as illustrated in FIG. 3, the intermediate portion 110D is inclined in a steeper manner than the upstream portion 110A and the downstream portion 110B as viewed in the X direction. For example, when the medium 22 having a large size of B0 plus is used, a jam of the medium 22 to be discharged is more likely to occur at the intermediate portion 110D. With this, a configuration in which the medium 22 easily moves on the intermediate portion 110D is preferred. Here, in the medium placement device 100 according to the present exemplary embodiment, the support unit 110 includes the upstream portion 110A, the downstream portion 110B, and the intermediate portion 110D, and the intermediate portion 110D is inclined in a steeper manner than the upstream portion and the downstream portion as viewed in the X direction. As described above, the intermediate portion 110D is inclined in a steeper manner, and hence the medium 22 can be moved on the intermediate portion 110D through use of a gravitational force in a particularly effective manner. Therefore, the medium placement device 100 according to the present exemplary embodiment is capable of stably stacking various types of the medium 22 in a particularly suitable manner without using electric power or the like.

In the present exemplary embodiment, the intermediate portion 110D is inclined in a steeper manner than the upstream portion 110A and the downstream portion 110B, and the upstream portion 110A is inclined in a steeper manner than the downstream portion 110B. However, the above-described configuration is not intended to result in limitation. For example, the upstream portion 110A and the downstream portion 110B may be inclined at the same degree. Further, in the present exemplary embodiment, the position of the intermediate portion 110D in the discharge direction A is in the vicinity of the center of the entire length of the support unit 110 in the discharge direction A. In other words, this position corresponds to a vicinity of the center of the medium 22 in the discharge direction A, which has a size of B0 plus being a maximum size stackable on the medium placement device 100 according to the present exemplary embodiment. However, the position and the length of the intermediate portion 110D in the discharge direction A are not particularly limited. The position and the length of the intermediate portion 110D in the discharge direction can be determined as appropriate in accordance with a type and a size of the medium 22 to be used.

Further, as illustrated in FIG. 4 and FIG. 6, the medium placement device 100 according to the present exemplary embodiment is configured so that a space S is provided between the first support unit 110*a* and the second support unit 110*b* in the X direction and the width of the space S in the X direction is larger than the width of the support surface 111 in the X direction. In other words, in the medium placement device 100 according to the present exemplary embodiment, a contact area between the support surface 111 and the medium 22 is small. With this, a frictional force between the support surface 111 and the medium 22 can be reduced, and various types of the medium 22 can be stacked in a particularly stable manner without using electric power or the like. Further, the support unit 110 can be formed to have light weight, and thus the medium placement device 100 can be reduced in weight.

Further, as illustrated in FIG. 2, FIG. 5, and the like, the medium placement device 100 according to the present exemplary embodiment includes a pressing unit 120 that presses down the medium 22, which is supported by the support unit 110, from above in the Z direction. Further, as illustrated in FIG. 5, the pressing unit 120 is arranged at a position facing the support surface 111 of the first support unit 110*a*. With this configuration of the medium placement device 100 according to the present exemplary embodiment, the medium 22 can be sandwiched in the vertical direction between the pressing unit 120 and the support surface 111 of the first support unit 110*a*. With this, the medium 22 can be prevented from curling as viewed in the X direction, and the part corresponding to the leading edge of the medium 22 can be prevented from being caught by the support surface 111 or a placed medium in a stable manner.

Further, as illustrated in FIG. 2 to FIG. 5 and the like, the medium placement device 100 according to the present exemplary embodiment includes a regulation unit 121 having a regulation surface 121A that is provided to extend from the side close to the support surface 111 (−Z side) to the side close to the pressing unit 120 (+Z side). With this, the medium 22 supported by the support unit 110 is prevented from moving downstream in the discharge direction A. With this, when the media 22 are continuously placed on the support unit 110, the leading edge of the subsequent medium 22 that is moving for placement is prevented from abutting against and being caught by a placed medium that is previously stacked below the subsequent medium. Thus, in an effective manner, improper discharge of the subsequent moving medium 22 can be prevented, and the placed medium can be prevented from being pushed out from the support unit 110.

Note that, as illustrated in FIG. 4, FIG. 5, and the like, in the medium placement device 100 according to the present exemplary embodiment, the regulation unit 121 is provided on the −X side in the X direction. This is because the recording device 10 that is used together with the medium placement device 100 according to the present exemplary embodiment includes the carriage 33 at a home position on the −X side, and is used with the medium 22 on the −X side. With this, the above-described configuration is not intended to result in limitation, and the medium placement device 100 may be arranged in a freely selectable manner in accordance with a mode of a processing device to be used in combination.

Further, as illustrated in FIG. 4 and FIG. 7, the medium placement device 100 according to the present exemplary embodiment includes a regulation unit holding shaft 122 provided along the discharge direction A. Further, the regulation unit 121 is movable along the regulation unit holding shaft 122. In this manner, the regulation unit 121 is movable along the discharge direction A. With this, in the medium placement device 100 according to the present exemplary embodiment, the position of the regulation unit 121 can suitably be changed in accordance with a size of the medium 22 to be used, and hence the medium 22 can suitably be stacked.

Further, as illustrated in FIG. 2 to FIG. 4, and the like, the pressing unit 120 of the medium placement device 100 according to the present exemplary embodiment includes an upstream pressing unit 120A and a downstream pressing unit 120B arranged at a position that is downstream of the upstream pressing unit 120A in the discharge direction A and includes the center in the X direction. With this, in the medium placement device 100 according to the present exemplary embodiment, only the upstream pressing unit 120A can be used when a short medium 22 is used, and both the upstream pressing unit 120A and the downstream pressing unit 120B can be use when a long medium 22 is used. Therefore, even when the long medium 22 is used as well as the short medium 22, the medium 22 can effectively be sandwiched between the pressing unit 120 and the support surface 111 in the vertical direction in the medium placement device 100 according to the present exemplary embodiment. When the short medium 22 is used, the downstream pressing unit 120B can rotatably move and be folded. FIG. 3 and FIG. 4 illustrate both states, namely, a use state and a non-use state.

Here, as illustrated in FIG. 3, FIG. 8, and the like, the upstream pressing unit 120A includes a base portion 1210 extending in the discharge direction A and a plurality of arm portions 1220 provided at positions of the base portion 1210, which faces the support surface 111. The arm portion 1220 has a base end 1221 and a distal end 1222 opposite to the base end 1221. The base end 1221 is rotatably attached to the base portion 1210 with the X direction as a rotational movement axis, and a rotating member 1223 that is rotatable with the X direction as a rotation axis is provided to the distal end 1222. Meanwhile, as illustrated in FIG. 7, the downstream pressing unit 120B is provided with a plurality of rotating bodies 1230 that extend in the discharge direction A and are rotatable with the X direction as a rotation axis at positions facing the support surface 111. Further, as illustrated in FIG. 7, a gap G1 between the downstream pressing unit 120B and the support surface 111 is configured to be smaller than a gap G2 between the base portion 1210 and the support surface 111.

In general, when the short medium 22 is used, the number of stacked media 22 is greater than a case in which the long medium 22 is used. For example, two rolls of the roll bodies 25 can be set in the recording device 10 in FIG. 1, which can be used together with the medium placement device 100 according to the present exemplary embodiment. Thus, when the roll body 25 is cut to have a short length, the number of media 22 is increased. Similarly, when the roll body 25 is cut to have a long length, the number of media 22 is reduced. In the medium placement device 100 according to the present exemplary embodiment, the gap G1 between the downstream pressing unit 120B and the support surface 111 is smaller than the gap G2 between the base portion 1210 and the support surface 111. With this, the number of stackable media 22 at the time of using the short medium 22 can be increased more than the number of stackable media 22 at the time of using the long medium 22. Further, the upstream pressing unit 120A includes the base portion 1210 and the plurality of arm portions 1220. The base end 1221 of the arm portion 1220 can rotatably move in the width direction as a rotational movement axis with respect to the base portion 1210, and the distal end 1222 of the arm portion 1220 is provided with the rotating member 1223. With this configuration, the medium 22 can firmly be pressed down upstream in the discharge direction A, and the medium 22 can suitably be moved. Further, the rotating member 1223 and the rotating body 1230 are provided, and hence the medium 22 can smoothly move.

Further, as illustrated in FIG. 2, FIG. 7, and the like, the medium placement device 100 according to the present exemplary embodiment includes casters 123 on the lower side in the gravitational direction at a downstream end 124 in the discharge direction A. With this, the casters 123 can be installed on the installation surface, and thus the medium placement device 100 can stably be installed. Moreover, the medium placement device 100 can easily move.

Further, as illustrated in FIG. 8, in the medium placement device 100 according to the present exemplary embodiment, the medium 22 is discharged by a roller pair provided to the discharge unit 53. The position of the roller pair of the discharge unit 53 is higher than the support surface 111 of the bridging member 110C by a predetermined height. In other words, the bridging member 110C is configured to be arranged below the discharge unit 53 with an interval equal to or larger than a thickness of the plurality of sheets of the medium 22. When the bridging member 110C is formed flush with the discharge unit 53, there may be a risk that a placed medium is pushed by a subsequent medium 22, which is discharged from the discharge unit 53 and moves, and moves from the desired placement position. However, in the medium placement device 100 according to the present exemplary embodiment, the bridging member 110C is configured to be arranged below the discharge unit 53 with an interval equal to or larger than a thickness of the plurality of sheets of the medium 22. With this, in the medium placement device 100 according to the present exemplary embodiment, a plurality of sheets of the medium 22 can suitably be stacked.

Figure 9:
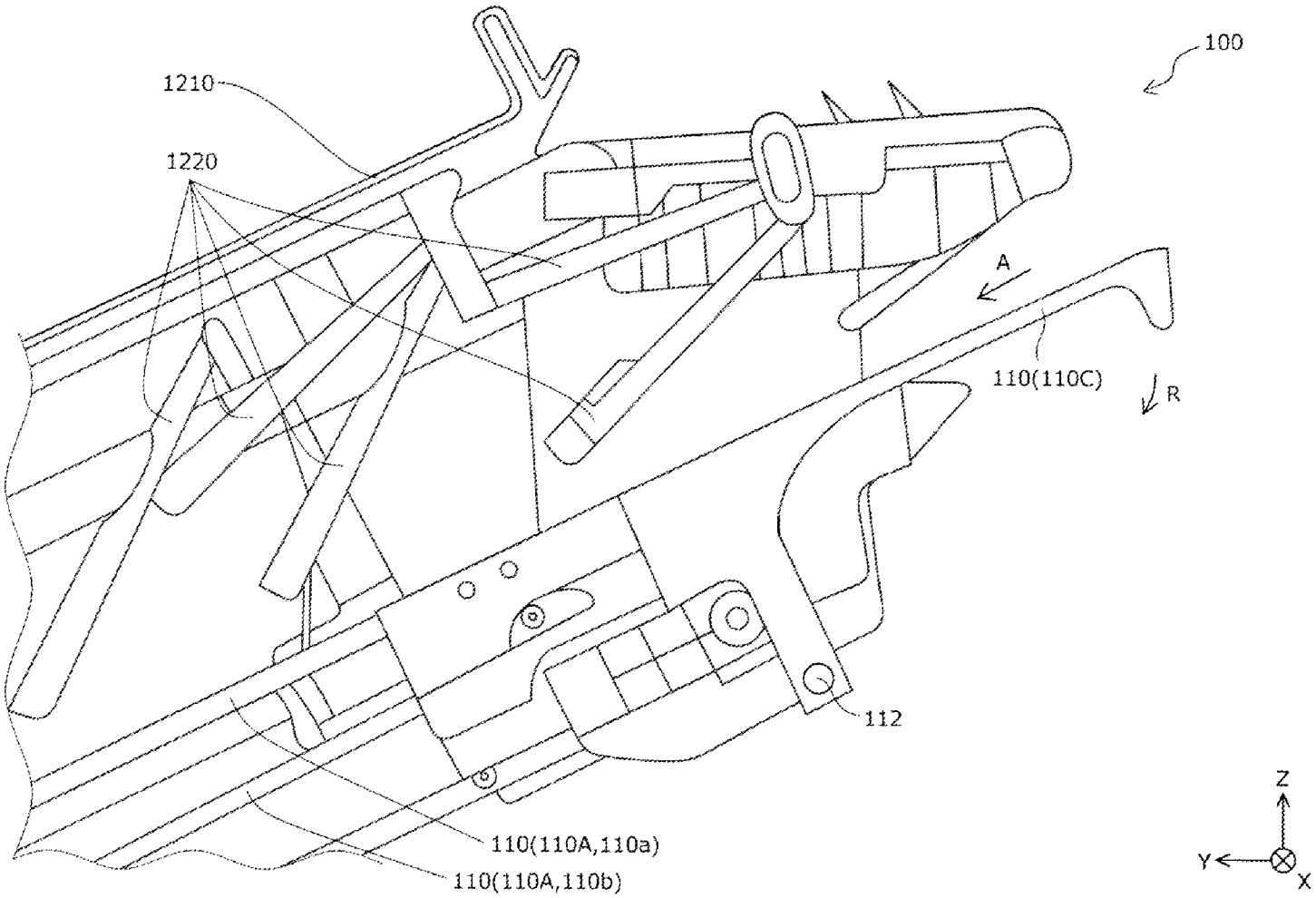
FIG. 9 is a side view illustrating a periphery of a bridging member of the medium placement device according to the first exemplary embodiment of the present disclosure.

Further, as illustrated in FIG. 9, the bridging member 110C includes a rotational movement shaft 112 that is rotationally movable with respect to the first support unit 110*a*. When a predetermined load or more is applied to the Z direction, the rotational movement shaft 112 rotationally moves in a rotational movement direction R with respect to the first support unit 110*a*. With this, the medium placement device 100 according to the present exemplary embodiment has such a configuration that breakage of the bridging member 110C or other parts of the support unit 110 can be prevented at the time of applying a predetermined load or more to the bridging member 110C in the Z direction.

Further, the bridging member 110C is configured to be detachable from the first support unit 110*a*, and is detached from the first support unit 110*a* without being deformed when a predetermined load or more is applied in the X direction. With this, the medium placement device 100 according to the present exemplary embodiment has such a configuration that breakage of the bridging member 110C or other parts of the support unit 110 can be prevented at the time of applying a predetermined load or more to the bridging member 110C in the X direction.

Second Exemplary Embodiment

Figure 10:
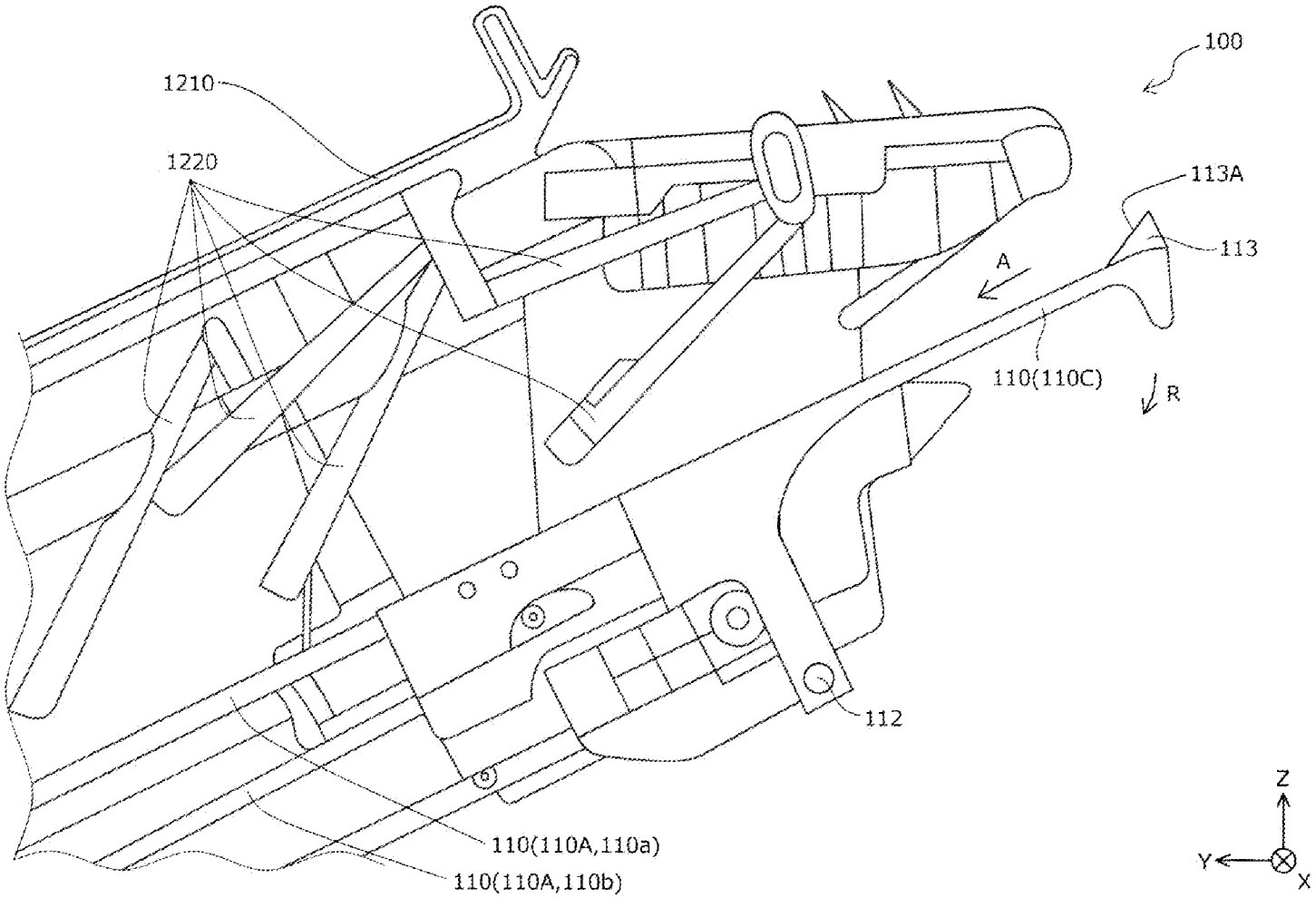
FIG. 10 is a side view illustrating a periphery of a bridging member of a medium placement device according to a second exemplary embodiment of the present disclosure.

Next, with reference to FIG. 10, a medium placement device 100 according to a second exemplary embodiment is described. Note that FIG. 10 is a view corresponding to FIG. 9 relating to the medium placement device 100 according to the first exemplary embodiment. The constituent members common to those in the first exemplary embodiment described above are denoted with the same reference symbols in FIG. 10, and the detailed description therefor is omitted. Here, the medium placement device 100 according to the present exemplary embodiment has a configuration similar to that of the medium placement device 100 according to the first exemplary embodiment, except for the configuration of the bridging member 110C. Thus, the medium placement device 100 according to the present exemplary embodiment has features similar to those of the medium placement device 100 according to the first exemplary embodiment, except for the matters described below.

As illustrated in FIG. 10, the medium placement device 100 according to the present exemplary embodiment includes a steep inclination portion 113 at the upstream end of the bridging member 110C in the discharge direction A. The steep inclination portion 113 has a steep inclination surface 113A that is inclined in a steeper manner than a region other than the support surface 111 of the bridging member 110C as viewed in the X direction. In other words, the bridging member 110C in the present exemplary embodiment includes the steep inclination portion 113 at the upstream end thereof in the discharge direction A. The steep inclination portion 113 in inclined downward in the gravitational direction from upstream to downstream in the discharge direction A in a steeper manner than a region other than the upstream end in the discharge direction A. For example, depending on a type of the medium 22, the medium 22 may have a leading edge that tends to hang down particularly easily. However, the bridging member 110C in the present exemplary embodiment includes the steep inclination portion 113 at the upstream end thereof in the discharge direction A. With this, even when the leading edge of the medium 22 hangs down, the leading edge is brought into contact with the steep inclination portion 113. With this, an entry angle of the leading edge into the bridging member 110C can be reduced, and the medium 22 can be moved in a particularly effective manner.

Third Exemplary Embodiment

Figure 11:
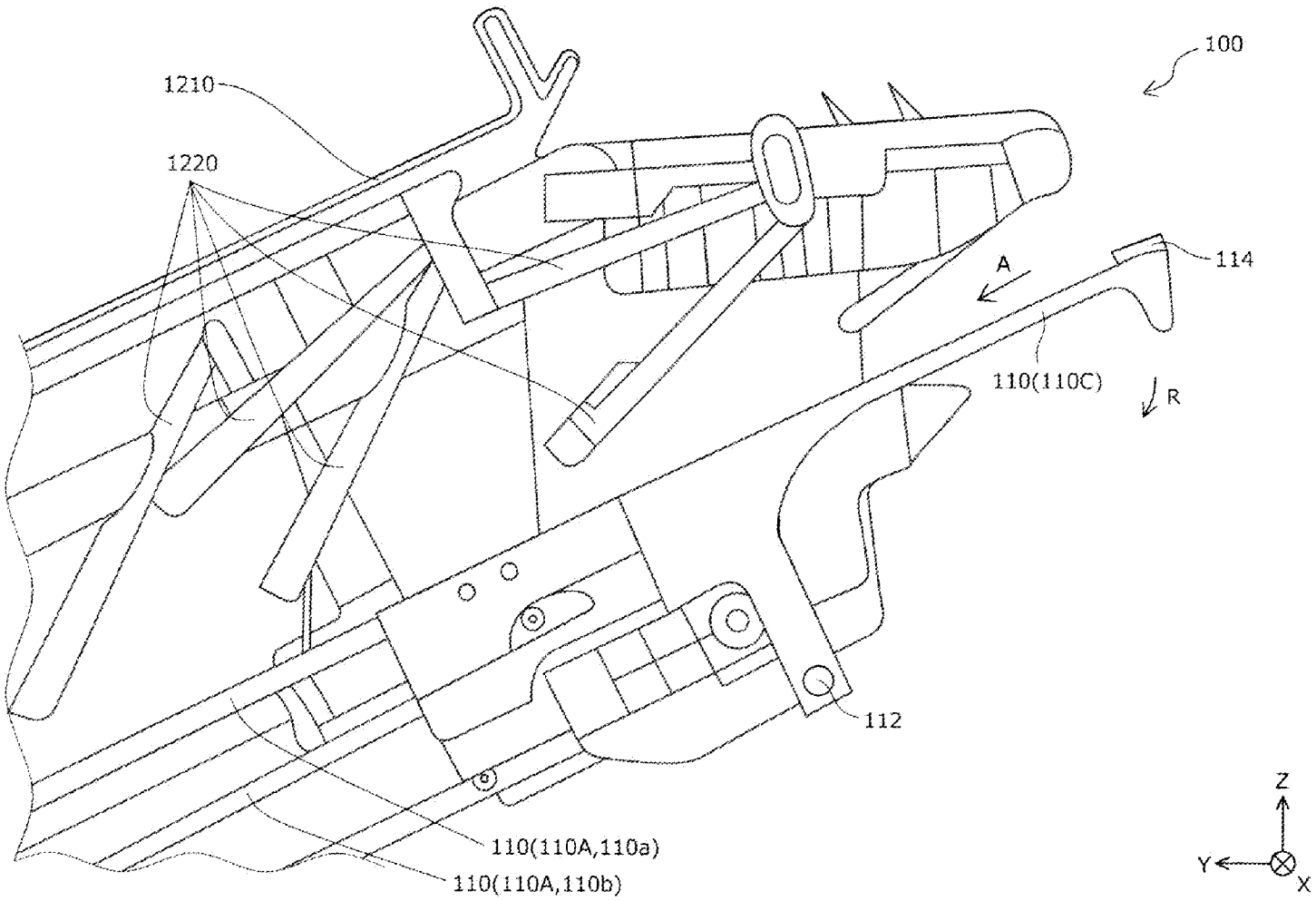
FIG. 11 is a side view illustrating a periphery of a bridging member of a medium placement device according to a third exemplary embodiment of the present disclosure.

Next, with reference to FIG. 11, a medium placement device 100 according to a third exemplary embodiment is described. Note that FIG. 11 is a view corresponding to FIG. 9 relating to the medium placement device 100 according to the first exemplary embodiment. The constituent members common to those in the first exemplary embodiment and the second exemplary embodiment described above are denoted with the same reference symbols in FIG. 11, and the detailed description therefor is omitted. Here, the medium placement device 100 according to the present exemplary embodiment has a configuration similar to those of the medium placement devices 100 according to the first exemplary embodiment and the second exemplary embodiment, except for the configuration of the bridging member 110C. Thus, the medium placement device 100 according to the present exemplary embodiment has features similar to those of the medium placement devices 100 according to the first exemplary embodiment and the second exemplary embodiment, except for the matters described below.

As illustrated in FIG. 11, the medium placement device 100 according to the present exemplary embodiment includes a high friction portion 114 at the upstream end of the bridging member 110C in the discharge direction A. Specifically, the bridging member 110C in the present exemplary embodiment includes the high friction portion 114 at the upstream end thereof in the discharge direction A. The high friction portion 114 has a static friction coefficient with respect to the medium 22, which is greater than that in a region other than the upstream end in the discharge direction A. With this, in the medium placement device 100 according to the present exemplary embodiment, a placed medium that is placed on the medium placement device 100 can prevented from sliding due to a gravitational force and moving from a desired placement position, and the placed medium can be prevented from being pushed by a subsequent medium 22, which is discharged from the discharge unit 53 and moves, and moving from the desired placement position.

Fourth Exemplary Embodiment

Figure 12:
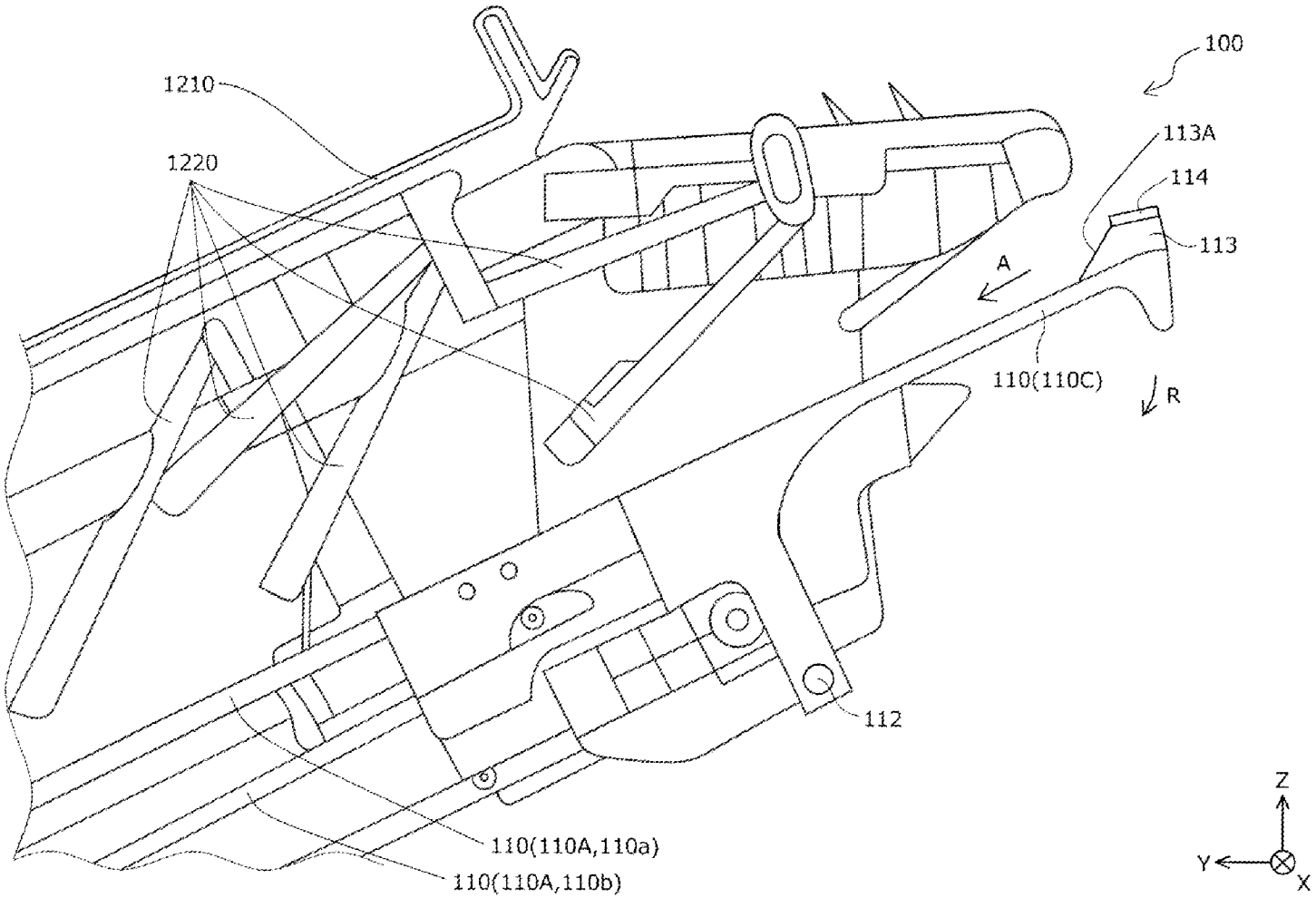
FIG. 12 is a side view illustrating a periphery of a bridging member of a medium placement device according to a fourth exemplary embodiment of the present disclosure.

Next, with reference to FIG. 12, a medium placement device 100 according to a fourth exemplary embodiment is described. Note that FIG. 12 is a view corresponding to FIG. 9 relating to the medium placement device 100 according to the first exemplary embodiment. The constituent members common to those in the first exemplary embodiment to the third exemplary embodiment described above are denoted with the same reference symbols in FIG. 12, and the detailed description therefor is omitted. Here, the medium placement device 100 according to the present exemplary embodiment has a configuration similar to those of the medium placement devices 100 according to the first exemplary embodiment to the third exemplary embodiment, except for the configuration of the bridging member 110C. Thus, the medium placement device 100 according to the present exemplary embodiment has features similar to those of the medium placement devices 100 according to the first exemplary embodiment to the third exemplary embodiment, except for the matters described below.

As illustrated in FIG. 12, the medium placement device 100 according to the present exemplary embodiment includes the steep inclination portion 113 having the steep inclination surface 113A at the upstream end of the bridging member 110C in the discharge direction A, which is similar to the medium placement device 100 according to the second exemplary embodiment, and further includes the high friction portion 114 at the upstream end of the bridging member 110C in the discharge direction A, which is similar to the medium placement device 100 according to the third exemplary embodiment. With this, the medium 22 can be moved in a particularly effective manner, and the placed medium can be prevented from moving from the desired placement position.

Fifth Exemplary Embodiment

Figure 13:
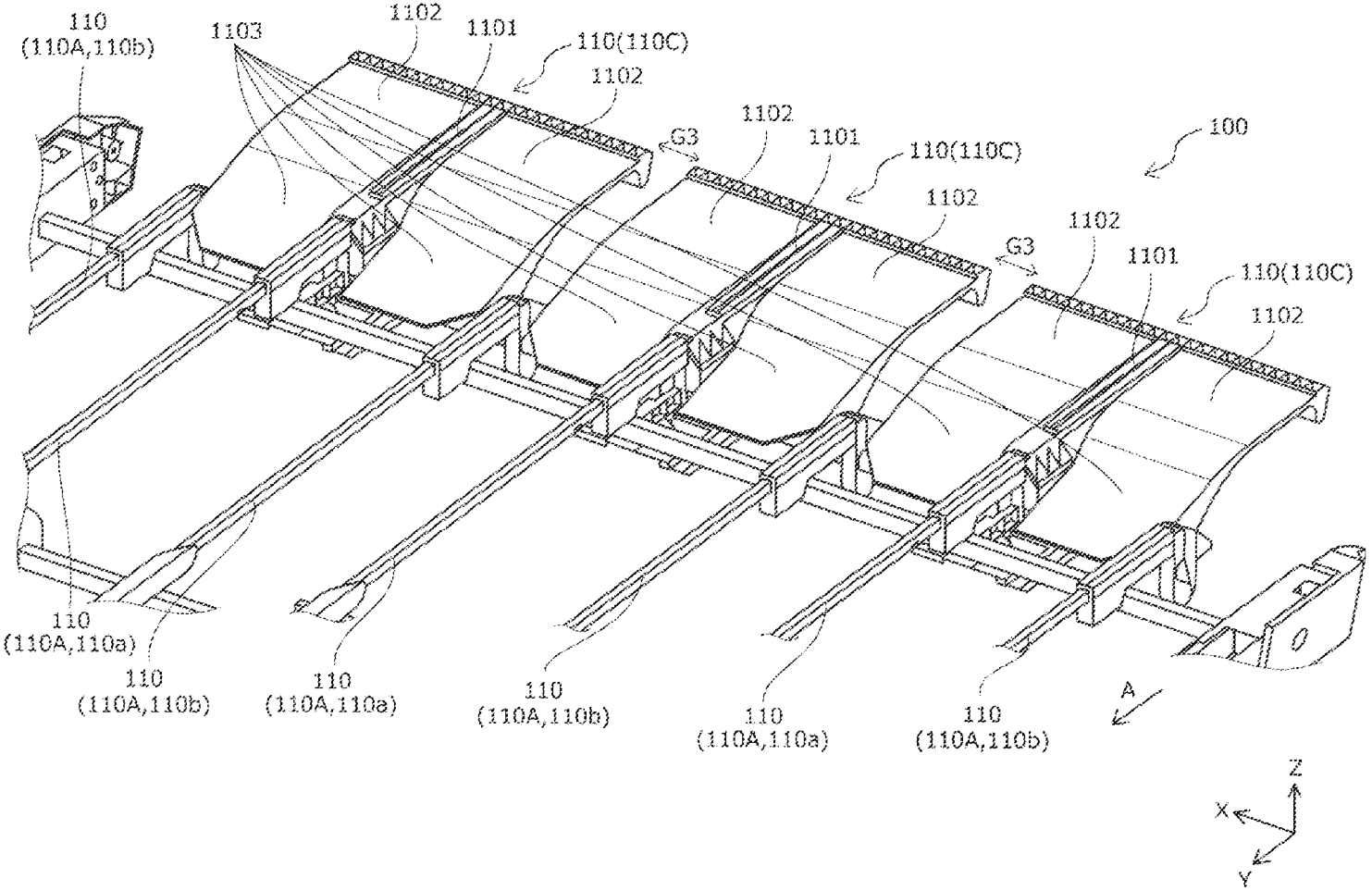
FIG. 13 is a perspective view of a periphery of a bridging member of a medium placement device according to a fifth exemplary embodiment of the present disclosure.
Figure 14:
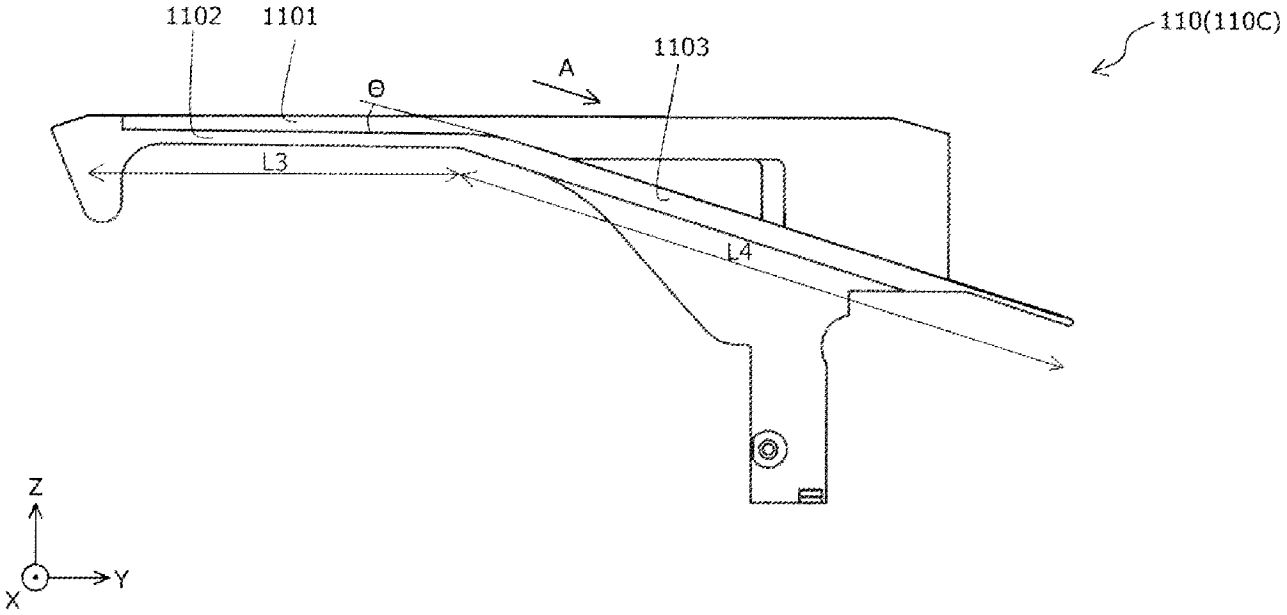
FIG. 14 is a side view of the bridging member of the medium placement device according to the fifth exemplary embodiment of the present disclosure.
Figure 15:
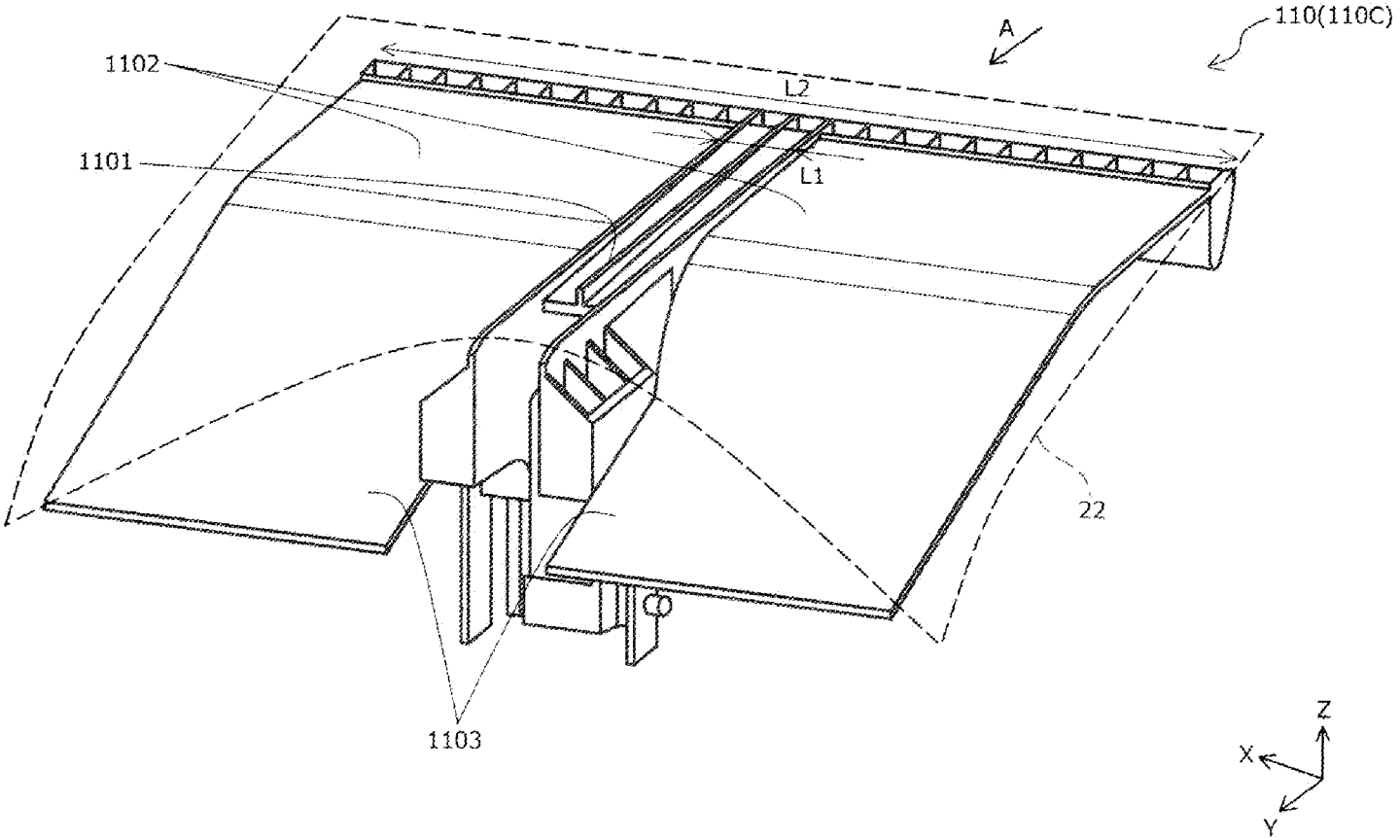
FIG. 15 is a perspective view of the bridging member of the medium placement device according to the fifth exemplary embodiment of the present disclosure.

Next, with reference to FIG. 13 to FIG. 15, a medium placement device 100 according to a fifth exemplary embodiment is described. The constituent members common to those in the first exemplary embodiment to the fourth exemplary embodiment described above are denoted with the same reference symbols in FIG. 13 to FIG. 15, and the detailed description therefor is omitted. Here, the medium placement device 100 according to the present exemplary embodiment has a configuration similar to those of the medium placement devices 100 according to the first exemplary embodiment to the fourth exemplary embodiment, except for the configuration of the bridging member 110C. Thus, the medium placement device 100 according to the present exemplary embodiment has features similar to those of the medium placement devices 100 according to the first exemplary embodiment to the fourth exemplary embodiment, except for the matters described below.

As illustrated in FIG. 13, the bridging member 110C in the present exemplary embodiment includes a first bridging portion 1101 extending from the first support unit 110*a* in the discharge direction A, a second bridging portion 1102 provided to each side of the first support unit in the X direction, and a third bridging portion 1103 that is provided downstream of the second bridging portion 1102 in the discharge direction A and is inclined downward in the gravitational direction from upstream to downstream in the discharge direction A in a steeper manner than the second bridging portion 1102. The medium placement device 100 according to the present exemplary embodiment has such a configuration. With this, as illustrated in FIG. 15, the medium 22 to be discharged can firmly be held at the second bridging portion 1102 upstream in the discharge direction A, and can have a wavy form at the third bridging portion 1103 downstream in the discharge direction A. With this, the leading edge in the discharge direction A can be prevented from hanging down, and can also be prevented from being caught by the support surface 111 or a placed medium in a particularly effective manner.

Here, the downstream end of the third bridging portion 1103 in the discharge direction A extends to a position lower than the height of the second support unit 110*b*. With this configuration, the medium 22 having a wavy form can reliably be fed to the second support unit 110*b*. Note that, in the present exemplary embodiment, a width L1 of the first support unit 110*a* for one bridging member 110C, which is illustrated in FIG. 15, is 23 mm. Further, a width L2 of the second support unit 110*b* for one bridging member 110C, which is illustrated in FIG. 15, is 257 mm. A gap G3 between the adjacent second bridging portions 1102, which is illustrated in FIG. 13, is 65 mm. A length L3 of the second support unit 110*b* in the discharge direction A, which is illustrated in FIG. 14, is 115 mm. Further, a length L4 of the third bridging portion 1103 in the discharge direction A for one bridging member 110C, which is illustrated in FIG. 14, is 159 mm. An angle θ formed by the second bridging portion 1102 with respect to the third bridging portion 1103, which is illustrated in FIG. 14, is 18 degrees. However, the above-described configuration is not intended to result in limitation.

The present disclosure is not limited to the exemplary embodiments described above, and can be achieved in various configurations without departing from the gist of the present disclosure. For example, appropriate replacements or combinations may be made to the technical features in the present exemplary embodiments which correspond to the technical features in the aspects described in the SUMMARY section to solve some or all of the problems described above or to achieve some or all of the advantageous effects described above. Additionally, when the technical features are not described herein as essential technical features, such technical features may be deleted appropriately.

What is claimed is:

1. A medium placement device configured to stack a plurality of sheets of a medium discharged from a discharge unit of a processing device, the medium placement device comprising a plurality of support units provided in a width direction intersecting with a discharge direction of the medium discharged from the discharge unit, the plurality of support units being configured to support the medium at a support surface from below in a gravitational direction, wherein as the plurality of support units, a first support unit and a second support unit are provided in an alternating manner in the width direction, the second support unit being arranged at a position lower than the first support unit in the gravitational direction when viewed in the width direction, the first support unit is provided with a bridging member configured to couple a lower side of the discharge unit in the gravitational direction and the support surface of the first support unit, and the plurality of support units and the bridging member extend in the discharge direction, and are inclined downward in the gravitational direction from upstream to downstream in the discharge direction.

2. The medium placement device according to claim 1, wherein the bridging member includes:

a first bridging portion extending from the first support unit in the discharge direction;

a second bridging portion provided to both sides of the first support unit in the width direction; and a third bridging portion provided downstream of the second bridging portion in the discharge direction, and having a slope inclined downward in the gravitational direction from upstream to downstream in the discharge direction, the slope being steeper than the second bridging portion.

3. The medium placement device according to claim 1, wherein the bridging member has a steep inclination portion, at an upstream end thereof in the discharge direction, having a slope inclined downward in the gravitational direction from upstream to downstream in the discharge direction, the slope being steeper than a region other than the upstream end in the discharge direction.

4. The medium placement device according to claim 1, wherein the bridging member includes a high friction portion at an upstream end thereof in the discharge direction, the high friction portion having a higher static friction coefficient, with respect to the medium, than that in a region other than the upstream end in the discharge direction.

5. The medium placement device according to claim 1, wherein the bridging member is configured to be arranged below the discharge unit in the gravitational direction by a thickness corresponding to a plurality of sheets of the medium or by the thickness or more.

6. A medium placement device configured to stack a plurality of sheets of a medium discharged from a discharge unit of a processing device, the medium placement device comprising a plurality of support units provided in a width direction intersecting with a discharge direction of the medium discharged from the discharge unit, the plurality of support units being configured to support the medium at a support surface from below in a gravitational direction, wherein as the plurality of support units, a first support unit and a second support unit are provided in an alternating manner in the width direction, the second support unit being arranged at a position lower than the first support unit in the gravitational direction when viewed in the width direction, the first support unit is provided with a bridging member configured to couple a lower side of the discharge unit in the gravitational direction and the support surface of the first support unit, and the bridging member includes a rotational movement shaft, and rotates about the rotational movement shaft with respect to the first support unit when a predetermined load or more is applied.

7. A medium placement device configured to stack a plurality of sheets of a medium discharged from a discharge unit of a processing device, the medium placement device comprising a plurality of support units provided in a width direction intersecting with a discharge direction of the medium discharged from the discharge unit, the plurality of support units being configured to support the medium at a support surface from below in a gravitational direction, wherein as the plurality of support units, a first support unit and a second support unit are provided in an alternating manner in the width direction, the second support unit being arranged at a position lower than the first support unit in the gravitational direction when viewed in the width direction, the first support unit is provided with a bridging member configured to couple a lower side of the discharge unit in the gravitational direction and the support surface of the first support unit, and the bridging member is configured to be detachable from the first support unit, and is detached from the first support unit when a predetermined load or more is applied.

* * * * *